US010100446B2

(12) United States Patent
Gessler et al.

(10) Patent No.: US 10,100,446 B2
(45) Date of Patent: Oct. 16, 2018

(54) MODULE ELEMENT FOR DRIVING AND RETAINING BRAIDING BOBBIN CARRIERS AND A BRAIDING DEVICE

(71) Applicant: Airbus Defence and Space GmbH, Ottobrunn (DE)

(72) Inventors: Andreas Gessler, Haar (DE); Christian Metzner, Munich (DE); Stefan Mittmann, Munich (DE); Bettina Arold, Stade (DE); Hermann Seefried, Birkhausen (DE)

(73) Assignee: Airbus Defence and Space GmbH, Ottobrunn (DE)

( * ) Notice: Subject to any disclaimer, the term of this patent is extended or adjusted under 35 U.S.C. 154(b) by 712 days.

(21) Appl. No.: 14/614,695

(22) Filed: Feb. 5, 2015

(65) Prior Publication Data

US 2015/0218739 A1 Aug. 6, 2015
US 2018/0223460 A9 Aug. 9, 2018

(51) Int. Cl.

| | |
|---|---|
| ***D04C 3/06*** | (2006.01) |
| ***D04C 3/22*** | (2006.01) |
| ***D04C 3/38*** | (2006.01) |
| ***D04C 3/18*** | (2006.01) |
| *D04C 3/24* | (2006.01) |
| *D04C 3/32* | (2006.01) |

(52) U.S. Cl.
CPC ..... *D04C 3/06* (2013.01); *D04C 3/18* (2013.01); *D04C 3/22* (2013.01); *D04C 3/38* (2013.01); *D04C 3/24* (2013.01); *D04C 3/32* (2013.01)

(58) Field of Classification Search
CPC ... D04C 3/06; D04C 3/18; D04C 3/22; D04C 3/38
See application file for complete search history.

(56) References Cited

U.S. PATENT DOCUMENTS

| | | | | |
|---|---|---|---|---|
| 1,103,181 A | | 7/1914 | Elliott | |
| 1,827,715 A | | 10/1931 | Robinson | |
| 3,714,862 A | * | 2/1973 | Berger | D04C 1/08 87/33 |
| 4,287,808 A | * | 9/1981 | Leonard | D03D 51/02 310/13 |
| 4,312,261 A | * | 1/1982 | Florentine | D03D 41/004 87/33 |
| 4,614,147 A | * | 9/1986 | Vendramini | D04C 1/06 87/11 |
| 4,800,796 A | * | 1/1989 | Vendramini | B27B 33/20 87/11 |

(Continued)

FOREIGN PATENT DOCUMENTS

| | | |
|---|---|---|
| DE | 691 31 656 T2 | 2/2000 |
| DE | 10 2012 205 906 A1 | 10/2013 |

OTHER PUBLICATIONS

German-language European Search Report dated Apr. 11, 2014 (seven (7) pages).

*Primary Examiner* — Shaun R Hurley
(74) *Attorney, Agent, or Firm* — Crowell & Moring LLP

(57) ABSTRACT

A module element for driving and retaining braiding bobbin carriers on a predetermined bobbin path has at least one base element that can rotate about an axis of rotation, and at least one retaining element that is formed integrally with the base element. The retaining element is configured to releasably hold at least one braiding bobbin carrier offset from the rotary axis.

9 Claims, 3 Drawing Sheets

(56) References Cited

U.S. PATENT DOCUMENTS

| | | | | | |
|---|---|---|---|---|---|
| 4,881,444 | A * | 11/1989 | Krauland | D04C 1/06 | 87/1 |
| 5,067,525 | A | 11/1991 | Tsuzuki et al. | | |
| 5,301,596 | A * | 4/1994 | Huey, Jr. | D04C 3/38 | 87/50 |
| 5,388,498 | A | 2/1995 | Dent et al. | | |
| 5,501,133 | A * | 3/1996 | Brookstein | D04C 1/06 | 87/33 |
| 6,439,096 | B1 * | 8/2002 | Mungalov | D04C 1/06 | 87/33 |
| 8,397,611 | B2 * | 3/2013 | Mejia | D04C 3/00 | 87/55 |
| 2009/0193961 | A1 * | 8/2009 | Jensen | B29C 53/564 | 87/8 |
| 2011/0277618 | A1 * | 11/2011 | Giszter | D04C 3/42 | 87/8 |
| 2015/0299916 | A1 * | 10/2015 | Reinisch | D04C 3/46 | 87/3 |

* cited by examiner

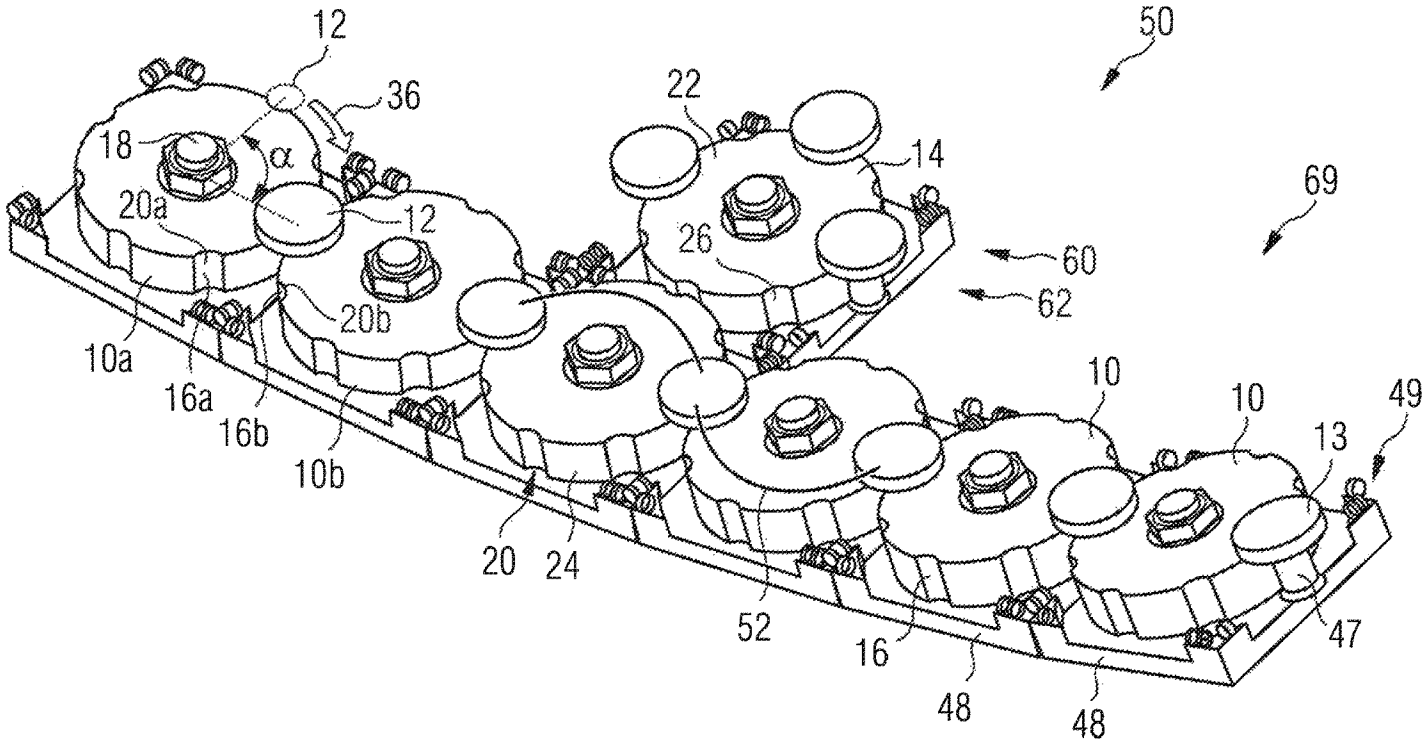
FIG 2
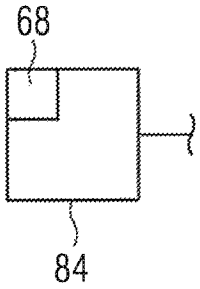

MODULE ELEMENT FOR DRIVING AND RETAINING BRAIDING BOBBIN CARRIERS AND A BRAIDING DEVICE

CROSS-REFERENCE TO RELATED APPLICATIONS

The present application claims priority under 35 U.S.C. § 119 to European application 14000432.6-1710, filed Feb. 6, 2014, the entire content of which is herein expressly incorporated by reference.

BACKGROUND AND SUMMARY OF THE INVENTION

Exemplary embodiments of the invention relate to a module element for driving and retaining braiding bobbin carriers, and a braiding device having a plurality of such module elements.

Modular braiding machines in which braiding bobbins are guided along predetermined paths to form a braid are known. For example, German patent document DE 691 31 656 T2 discloses a braiding machine comprising a plurality of track modules and driver modules.

When they are correspondingly arranged in a series, the track modules provide paths formed by recesses in a plate for the braiding bobbin carriers with which spool elements are engaged. The driver modules are arranged below the track modules and engage with a projection of the spool element extending downwards. By rotating the driver modules, the projections of the spool elements are all transferred to the next driver module, and the spool elements forming the braiding bobbin carriers are hence moved forward and follow the paths of a predetermined bobbin path established by the track modules.

Given the modular design, the described braiding device can be adapted to different geometries that are to be realized in the braid to be created; however, this is only feasible in a single plane. In addition, the prior art braiding machine has weak points at the places where the braiding bobbin carriers engage with the track and driver modules since the parts are exposed to wear and soiling in these locations due to the use of the braiding device. Furthermore, although the bobbin paths can be adjusted relatively flexibly, they remain restricted to the paths established by the track modules.

Exemplary embodiments of the invention are directed to an improved module element for driving and retaining braiding bobbin carriers, as well as an improved braiding device that can overcome the cited disadvantages.

A module element for driving and retaining braiding bobbin carriers on a predetermined bobbin path has at least one base element that can rotate about an axis, and at least one retaining element which is formed integrally with the base element, the retaining element being designed to releasably hold at least one braiding bobbin carrier offset from the rotary axis.

During operation the module element rotates about the rotary axis, wherein the at least one retaining element rotates with the base element about the common rotary axis. The drive is advantageously provided, for example, by a motor arranged in the area of the rotary axis. During rotation about this common rotary axis, the retaining element can grasp an oncoming braiding bobbin carrier at any desired time and hence at any desired position along the circular path of the retaining element, and carry it up to a desired position on the circular path of the retaining element around the common rotary axis where it is released. The entrained braiding bobbin carrier is driven by the rotation of the base element that entrains the integrally formed retaining element along the circular path. The braiding bobbin carrier can hence be flexibly brought from a held position to a released position along the circular path of the retaining element without being limited to predetermined paths.

In an advantageous embodiment, the rotatable base element has a wheel, and the retaining element is arranged on an outer circumference of the wheel to hold a braiding bobbin carrier.

It is hence preferably possible to arrange a plurality of retaining elements over the entire 360° circumference so that a plurality of braiding bobbin carriers can also be advantageously driven and transported further simultaneously by the module elements.

If the retaining element is furthermore advantageously designed, for example, with a notch, an area is available to retain braiding bobbin carriers that can be engaged with a corresponding area of a braiding bobbin carrier to preferably enable secure retention of the braiding bobbin carrier.

In a preferred embodiment, the retaining element has a retaining device with a magnetic device, especially with an electromagnet, formed to magnetically attract and repel braiding bobbin carriers. For example, at least one electromagnet is arranged within the interior of the wheel, preferably in the area of the notch. The electromagnet is particularly preferably formed by a coil that belongs to a motor which propels the rotational movement of the base element.

By means of the magnetic attraction and repulsion between the magnetic device and braiding bobbin carrier, mechanical engagement in a track element normally used in the prior art for capturing, retaining and transporting braiding bobbin carriers can be advantageously discarded, which can advantageously greatly minimize signs of wear on the module element or the braiding bobbin carrier.

Alternatively or in addition to a magnetic device, a suction and/or blowing mechanism can be provided as a retaining device. A mechanical gripper as an alternative is also conceivable, wherein, however, a magnetic device constitutes the advantageous embodiment in regard to reducing wear. Instead of a notch, a wing extending away from the base element can also be provided as the retaining element.

More preferably, a control element for controlling the module element is provided, in particular a control element for controlling a rotary speed of the base element and a retaining force that acts upon a braiding bobbin carrier at a predetermined angle of rotation of the base element.

By means of such a control, a braiding bobbin carrier can be preferably brought at a predetermined speed to a predetermined angular position of the retaining element by elevating the retaining force high enough for the braiding bobbin carrier to be retained by the retaining element. Once the predetermined angular position is reached, the retaining force is advantageously reduced enough, for example by turning off an electromagnet, so that the braiding bobbin carrier is no longer retained by the retaining element, and it can preferably leave the module element at the desired position.

Particularly preferably, the module element has at least four retaining elements which, in a particularly preferred embodiment, are arranged evenly on an outer circumference of the base element.

Accordingly, four braiding bobbin carriers can advantageously be simultaneously driven, retained and transported further by the module element.

It is, however, also possible to provide more than four retaining elements on one module element. This is, for example, advantageous when the relevant module element is to be used as a parking position as described below. Accordingly in this case, a plurality of braiding bobbin carriers can be advantageously held simultaneously by the module element.

An advantageous combination of at least one module element as described above and at least one braiding bobbin carrier has a braiding bobbin carrier that has at least one magnetic area for interacting with the retaining element of the module element.

The magnetic area can, for example, be advantageously formed by a projecting rod. In a particularly advantageous manner, the projecting rod is designed to be complementary with the notch.

More advantageously, the magnetic area has a support plate to which the projecting rod can be fastened, and which can abut a surface of the wheel for additional advantageous stabilization.

For example, the magnetic area can be formed by providing ferromagnetic material that can be attracted by a magnet. Alternatively, the braiding bobbin carrier can also have a magnet, such as an electromagnet, that interacts with the magnet on the retaining device of the module element, wherein the magnets attract each other in order to preferably hold the braiding bobbin carrier and repel each other in order to preferably push to the braiding bobbin carrier away from the module element.

Instead of a magnet on the retaining device, a magnetic area such as a ferromagnetic material can also be alternatively provided on the retaining device, wherein the braiding bobbin carrier then advantageously has a magnet, especially an electromagnet.

A braiding device for braiding fibrous semifinished products has a plurality of the above-described module elements, wherein the module elements are arranged relative to each other such that at least one first retaining element of a first module element can transfer braiding bobbin carriers in the air to a second retaining element of a second module element along a predetermined bobbin path.

This means that the module elements are arranged relative to each other such that the retaining elements are at a distance that can be overcome by a braiding bobbin carrier to be transported further only by the active retaining force, such as magnetic force, of the retaining devices of the two module elements. If the first module element accordingly releases the braiding bobbin carrier, the retaining device of the second module device is advantageously activated so that the braiding bobbin carrier passes from the first retaining element of the first module element to the second retaining element of the second module element.

With such a braiding device, a plurality of braiding bobbin carriers can be transferred to a subsequent module element at a predetermined angular position of the individual module elements. The module elements can be arranged freely within space relative to each other, while only advantageously fulfilling the condition that the distance between the two neighboring retaining elements of different module elements can be overcome by the retaining force. Consequently, any geometry that could be desired within a braid can be created. Since furthermore the contact between braiding bobbin carriers and module elements only occurs briefly and without significant mechanical strain, the wear of the parts of the braiding device is minimal.

The module elements are advantageously arranged in a series and/or parallel to each other so that flat fibrous semifinished products can be advantageously braided.

Alternatively or in addition, the module elements can also be arranged in several planes relative to each other so that preferably three-dimensional fibrous semifinished products can be braided with several layers.

More advantageously, it is possible to arrange the module elements in a circle so that preferably tubular fibrous semifinished products can be braided.

All types of arrangement—serial, parallel, in several planes and circular—can advantageously be provided in combination or separately from each other depending on the geometry of the braid to be created.

In a particularly preferred embodiment, the braiding device also has a servicing device for forming at least one parking position for at least one braiding bobbin carrier. Such a servicing device can, for example, be formed by a rotating module element that is arranged outside of the predetermined bobbin path of the braiding bobbin carrier to be parked. With such an arrangement, it is possible to advantageously supply braiding bobbin carriers as desired to the braiding process, or remove them from the braiding process, in order, for example, to prevent changes in the circumference of a braid to be created.

On the one hand, braiding bobbin carriers can be advantageously removed from the braiding process that guide the actual braiding threads in the braiding process. Alternatively or in addition, it is also advantageously possible to remove those braiding bobbin carriers from the braiding process that guide the support threads i.e., the threads that are guided opposite the direction in which the actual braiding threads are guided. This advantageously makes it possible to change between UD braiding and multi-tow winding in a braiding process.

A control device is preferably provided to control the module elements, wherein the control device controls the module elements such that a multidimensional braid is formed, especially with several braiding layers.

In addition, the control device preferably has a memory unit in which predetermined bobbin paths are saved to form predetermined fibrous semifinished products. By means of the predetermined bobbin paths, the control device can preferably control the module elements so that the braiding bobbin carriers move along the predetermined bobbin paths to yield the predetermined shape of the fibrous semifinished product.

In a particularly preferred embodiment, the braiding device has a plurality of module elements as well as a plurality of braiding bobbin carriers that each have at least one magnetic area for interacting with the retaining elements of the module elements.

BRIEF DESCRIPTION OF THE DRAWING FIGURES

Exemplary embodiments of the invention are explained below in greater detail with reference to accompanying drawings. In the drawings:

FIG. 2 shows the transfer of braiding bobbin carriers between module elements according to FIG. 1.

DETAILED DESCRIPTION

Figure 1:
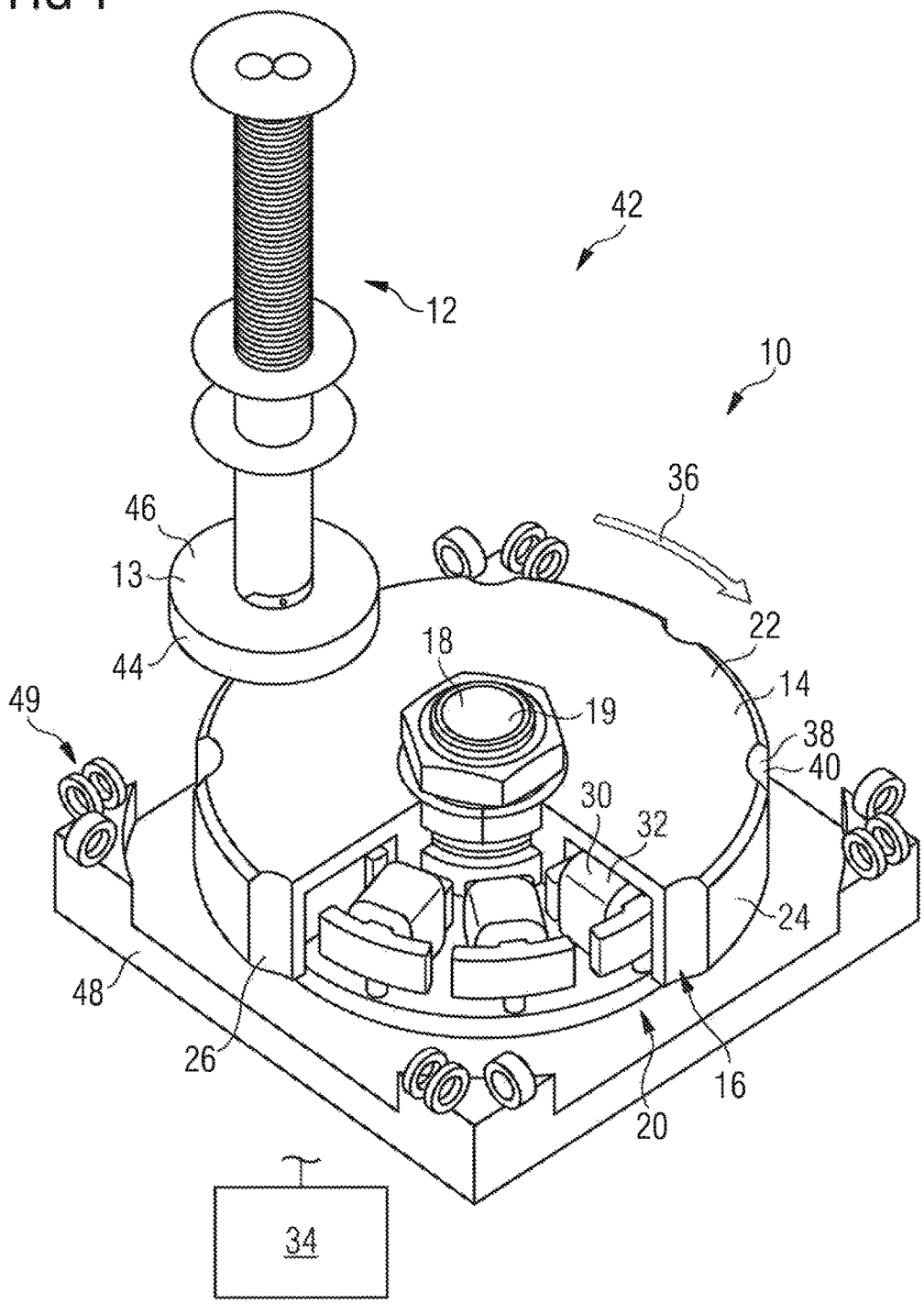
FIG. 1 shows a module element for driving and retaining braiding bobbin carriers.

FIG. 1 shows a module element 10 for driving and retaining braiding bobbin carriers 12 that have support plates 13. The braiding bobbin carriers 12 abut the module element 10 by means of the support plate 13.

The module element 10 has a base element 14 and a plurality of retaining elements 16 that are formed integrally with the base element 14 and that can be rotated with the base element 14 about a common rotary axis 18. The base element 14 is driven in the rotary axis 18 by means of a motor 19. Each retaining element 16 has at least one retaining device 20 by means of which a braiding bobbin carrier 12 can be securely retained by the retaining element 16.

In the present embodiment, the base element 14 is designed as a wheel 22 on the circumference 24 of which the retaining elements 16 are arranged symmetrically in the form of notches 26.

The retaining devices 20 are arranged within the interior of the wheel 22 and are designed as magnetic devices 30, electromagnets 32 in the present embodiment. By means of the electromagnets 32, braiding bobbin carriers 12 can be securely retained by the retaining device 20, attracted by the retaining device 20, and repelled by the same.

The module element 10 also has a control element 34 by means of which the elements of the module element 10 can be controlled. In particular, this controls a rotational speed of the base element 14 and retaining elements 16 about a common rotary axis 18 and a direction of rotation 36. Furthermore, the control unit 34 also controls the magnetic devices 30.

A suction/blowing mechanism 38 can also be provided as a retaining device 20 instead of the magnetic devices 30, or a mechanical gripper 40 can be provided.

By means of the control element 34, the retaining force, for example, is controlled so that the retaining device 20 exerts on the braiding bobbin carrier 12 to be captured/retained/released. Furthermore, the control element 34 can, for example, also control the rotational speed of the base element 14 and/or the positioning of the braiding bobbin carrier 12.

Figure 3:
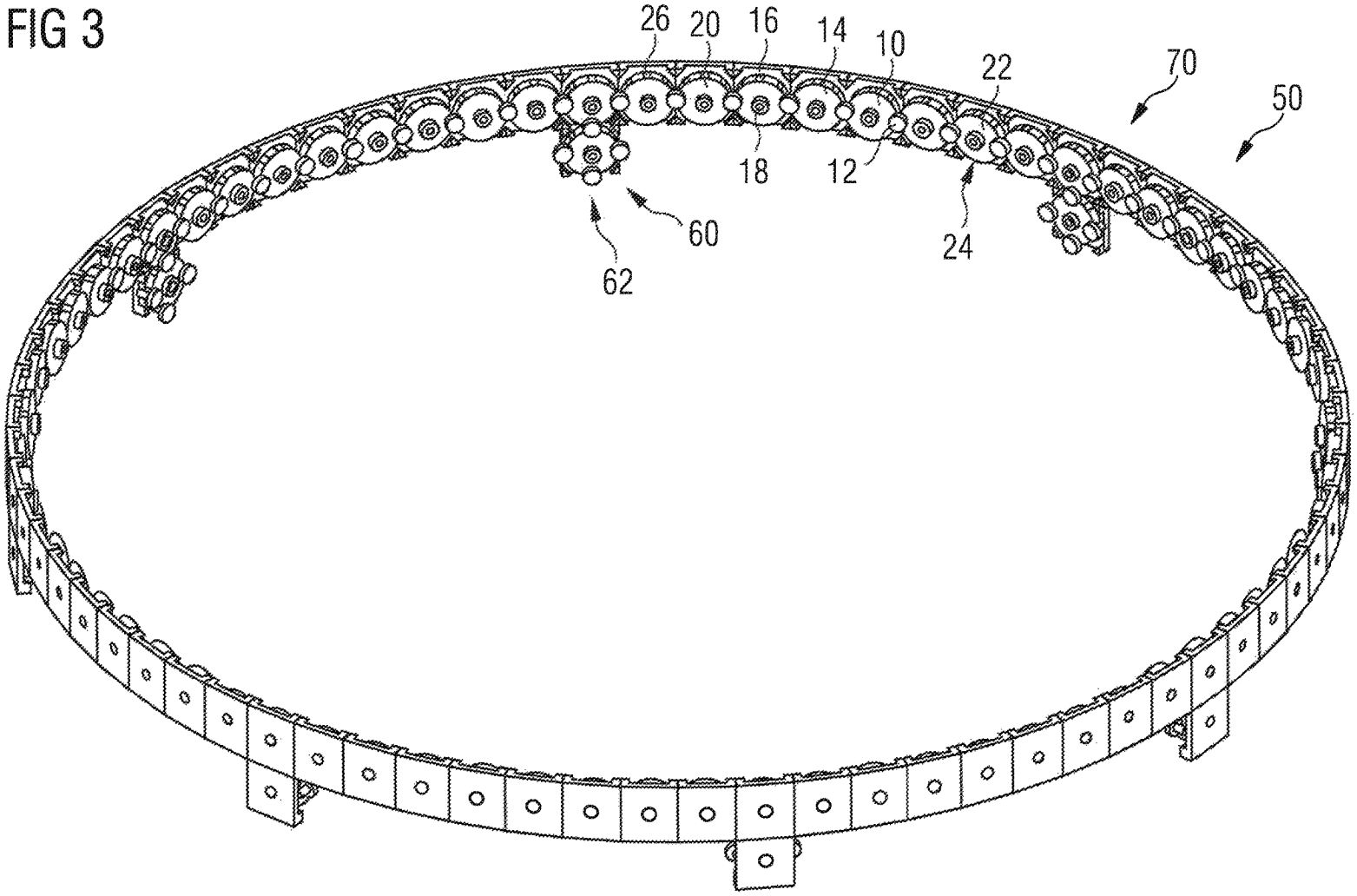
FIG. 3 shows a braiding device with module elements arranged in a circle according to FIG. 1.

FIG. 1 shows a combination 42 consisting of a module element 10 with a braiding bobbin carrier 12 that is securely retained by the module element 10 and is transported along a direction of rotation 36. Only the support plate 13 of the braiding bobbin carrier 12 is shown in FIG. 2 and FIG. 3.

In the present embodiment, the braiding bobbin carrier 12 comprises a magnetic area of 44 such as a ferromagnetic block 46 that interacts with the retaining device 20 of the module element 10 so that the braiding bobbin carrier 12 can be retained by the retaining element 16. In addition to the support plate 13, the braiding bobbin carrier 12 in the present embodiment has a projecting rod 47 that can be brought into engagement with the notch 26.

The base element 14 is attached to a retaining plate 48 having a plurality of fastening elements 49 in order to arrange module elements 10 in different positions relative to each other and fasten them on each other.

An exemplary arrangement of a number of combinations 42 is shown in FIG. 2. FIG. 2 shows the progressive transportation and transfer of a braiding bobbin carrier 12 from one module element 10*a* to another module element 10*b* by means of a plurality of braiding bobbin carriers 12. The position of a braiding bobbin carrier 12 is indicated by a dashed line at a time that is before the situation indicated by continuous lines. Between the two times, the module element 10*a* has executed a rotation along at the rotational direction 36 such that the retaining element 16*a* has traveled past the angle of rotation a and has arrived at a predetermined angular position. At this predetermined angular position, a second retaining element 16*b* of a second module element 10*b* approaches the magnetic area 44 of the securely retained braiding bobbin carrier 12.

The retaining device 20*a* of the first retaining element 16*a* is deactivated, and the second retaining device 20*b* of the second retaining element 16*b* is activated. This causes the braiding bobbin carrier 12 to release from the first module element 10*a* and pass to the second module element 10*b* where it is transported further along the rotational direction 36.

FIG. 2 shows a first possible embodiment of a braiding device 50 having a plurality of module elements 10 according to FIG. 1. Different braiding bobbin carriers 12 in this braiding device 50 are moved by the module elements 10 along predetermined bobbin paths 52 such that threads released at predetermined positions by the braiding bobbin carriers 12 cross and thereby form a braid such as a fibrous semifinished product.

The braiding device 50 in FIG. 2 has a servicing device 60 that forms a parked position 62 for the braiding bobbin carrier 12. Accordingly, braiding bobbin carriers 12 that cannot or should not be used in the braiding process at a specific time during the braiding process can be intermittently parked in the parked position 62 and supplied to the braiding process at a later time in the braiding process where they can again be used. This advantageously applies both to braiding bobbin carriers 12 that guide the actual braiding threads as well as the braiding bobbin carriers 12 that guide the support threads.

Moreover, a control device at 84 is provided in the braiding device 50 that controls the module elements 10 in order to form a multidimensional braid during the braiding process. The control unit 84 has a memory unit 68 in which predetermined bobbin paths 52 are saved in order to control the module elements 10 so that the desired braid can be created as the braiding bobbin carriers 12 travel along the predetermined bobbin paths 52.

In the embodiment shown in FIG. 2, the module elements 10 are arranged relative to each other in a series in a plane 69. Several series can be arranged parallel to each other.

FIG. 3 shows a braiding device 50 in which the module elements 10 are arranged in a circle 70. Normally, a braiding core (not shown) is located centrally in the circle 70. A braid forms on the braiding core from the movement of the braiding bobbin holder 12 on the circle 70.

The range of output of standard braiding machines known to date is rather inflexible given the design. Subsequent adaptations can only be realized with difficulty by intervening in the textile parameters such as the weight per unit area, the fiber titer, the skein, the angle of twist, the number of bobbins, etc. With standard braiding machines, changes in the textile parameters during the process are only feasible within a certain range under specific contexts. Furthermore, there is the problem of the wear and soiling of the machine from the mechanical construction.

The development of a radial braider by the Herzog company was a significant advance, as well as a machine for realizing variable braiding patterns, wherein the machine type functions for wire braiding, for example. However, a large number of bobbins, large circumferences, fast circulating speeds, the processing of plastic fibers and a variable machine size are only realizable with difficulty. The braiding machines 50 currently in use such as radial or axial braiders have the following disadvantages:

the maximum number of bobbins is determined by the number of wheels bearing the bobbins so that the machine cannot be smoothly adapted to the part with the exception of developing or purchasing an entire new machine;

it is necessary to adapt, i.e., always reduce, the number of bobbins and/or the circumference of the part which always results in more scrap and a lower maximum braiding speed since the machine has high bobbin revolution times because the braids are relatively large;

the skein can only be influenced by drastically reducing the number of bobbins;

locally removing individual bobbins to reduce the number of bobbins results in local differences in weight per unit area since the angle between the bobbins is not adapted;

it takes a great deal of effort to equip a braiding machine;

up to now, fully-automated equipping is only theoretically possible; in practice, shunts have had to be provided in the guide paths;

a standing braiding machine manifests a gravity effect on the textile pattern, i.e., differing thread tension at upper positions in comparison to lower positions, wherein the gravity effect is particularly noticeable in large braiding machines with their large diameters;

single or several bobbins cannot be parked; the paths are fixed;

there is great potential for soiling and wear of the bobbin paths and impellers.

The following requirements therefore exists for an improved braiding device 50:

variable speed of the impellers depending on the circumference and degree of coverage, angle and fiber titer of the parts;

the angles between the bobbins 12 should smoothly equalize so that the number of bobbins can be smoothly adjusted to the circumference of the part;

more than four retaining positions on the support wheels are desirable to make possible various skeins or also guide more than one bobbin 12 in sequence;

no guide paths for the bobbins 12 to increase the degrees of freedom in regard to the skein, the parking of bobbins 12 and automated equipping, and to decrease potential soiling and wear;

It is advantageous that lying braiding machines 50 can be provided with the described design to reduce the gravity effect of large braiding machines 50 and improve the accessibility of the bobbins 12.

It is therefore proposed to construct structurally identical individual module elements 10 into an overall machine 50 in an optimal, desired size, wherein an open or closed cross-section, circular, linear or cruciform shape and 2-D and 3-D geometries can be realized. Each module element 10 can be placed on each other in series or in parallel, whereby one or more bobbin paths 52 can be realized. One module element 10 possesses one impeller 22 or a pair of impellers to advance the braiding bobbin carrier 12. The braiding bobbin carriers 12 only adhere to the impellers 22; there are no fixed paths in the braiding device 50. The bobbin transfer is from impeller 22 to impeller 22 in an actively controlled manner. There are significantly more than four fixed points on the impellers 22.

The advantage is that a variable braiding machine 50 is provided that can be adapted to the requirements of the part to be created, particularly in regard to productivity, machine costs and optimizable textile parameters. The textile cross-sectional geometry, that is, the size, shape, 2-D, 3-D, open or closed, and the textile cross-sectional parameters such as the skein, angle, weight per unit area, etc. are not limited by the braiding device 50. Improvements during the process such as parking or supplying braiding bobbin carriers 12 to prevent changes in the circumference are possible. Furthermore, the braiding device 50 is scarcely susceptible to soiling since there are no guide grooves. There is no influence of gravity on the threads to be braided. Overall, the braiding device 50 is more accessible and can be automatically equipped in an on-the-fly process. The angles between the modules 10 can automatically adjust under spring force, or can be actively adjusted.

Particularly in comparison to the braiding device in German patent document DE 691 31 656 T2, the module elements 10 described here work without guide paths since the braiding bobbin carriers 12 are fixed magnetically to the impellers 22, which yields the significant advantage that the bobbin paths 52 are entirely freely selectable and are not predetermined by the system design. Local parking, supplying and turning of the bobbins, etc. can hence be realized, and soiling is avoided since transferring is not mechanical.

A high degree of precision exists in the synchronization of the impellers 22 when holding and transferring the bobbins, especially at the transfer points. A system is provided to hold the braiding bobbin carrier and to drive the bobbin 12. The bobbins 12 are subject to traction toward the braiding center and in a radial direction. Consequently, a holder is provided to compensate for the pull and radial force.

As a drive system to advance the bobbins 12 by the impeller module 10, for example, the impeller 22 itself can, for example, be driven by e.g. providing a motor 19 on each, or on each x-th, module 10. The bobbins are grasped by electromagnets 32 which can be designed to be active or passive and rotate conjointly, or are arranged locally or fixed. The transfer is preferably active.

In an active system, the impeller 22 rotates freely and the bobbins are grasped by active electromagnets 32, the respective electromagnet 32 of a neighboring impeller being 22 deactivated or activated during the transfer. Advancement occurs by regularly commutating the fixed electromagnets 32. In a passive system, the impellers 22 are freely rotating and the bobbins are grasped by permanent magnets, wherein the transfer occurs using fixed or local electromagnets 32 by suspending the magnetic field.

With the inventive braiding machine 50, the size of the braiding machine 50 is freely selectable or adjustable depending on the required part, budget, etc. Open or closed braiding machines 50 are possible depending on the arrangement of the module elements 10. Consequently, the braider can be adapted to flat goods, 2-D or 3-D braids, T cross-sections, cruciform cross-sections and linear cross-sections. The braiding machine 50 is easy to equip by simply inserting or magnetically attracting bobbins 12. In addition, the bobbins 12 can be retracted locally. Since there are more than four fixed points on the impellers 22, the skein is adaptable. Depending on the diameter of the braiding device 50, the angle between the bobbins 12 adjusts automatically. The bobbins 12 can be parked or also positioned on other paths. In addition, accessibility is favorable, and there is no gravity effect from a lying braiding machine 50.

The braiding machine described in German patent document DE 691 31 656 T2 is always only constructed in a plane. In contrast, the module elements 10 described here can be arranged in a plane, but they can also be arranged circular to form a tunnel braiding machine, or the circular arrangement can also be in several planes 69. In particular, by constructing a tunnel braiding machine, it is possible to produce carbon-fiber reinforced plastic components in an overbraiding technique.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

REFERENCE NUMBER LIST

10 Module element
10*a* First module element
10*b* Second module element
12 Braiding bobbin carrier
13 Support plate
14 Base element
16 Retaining element
16*a* First retaining element
16*b* Second retaining element
18 Rotary axis
19 Motor
20 Retaining device
20*a* First retaining device
20*b* Second retaining device
22 Wheel
24 Scope
26 Notch
30 Magnet device
32 Electromagnet
34 Control element
36 Direction of rotation
38 Suction and blowing mechanism
40 Gripper
42 Combination
44 Magnetic area
46 Ferromagnetic block
47 Projecting rod
48 Retaining plate
49 Fixing element
50 Braiding device
52 Bobbin path
60 Servicing device
62 Park position
84 Control device
68 Memory unit
69 Plae
70 Circl
α Angle of rotation

What is claimed is:

1. A braiding device for braiding fibrous semifinished products, the braiding device comprising:

a plurality of module elements for driving and retaining braiding bobbin carriers on a predetermined bobbin path, each of the module element comprising a base element that is rotatable about an axis of rotation; and a retaining element integrally formed with the base element, wherein the retaining element releasably holds at least one braiding bobbin carrier offset from the axis of rotation using a first electromagnet, wherein the plurality of module elements are arranged relative to each other such that at least one first retaining element of a first module element transfers the braiding bobbin carriers to a second retaining element of a second module element along the predetermined bobbin path, wherein the transfer occurs by suspending a magnetic field of the first electromagnet.

2. The braiding device element of claim 1, wherein the plurality of module elements are configured to braid a flat fibrous semifinished product by being arranged in series or in parallel relative to each other.

3. The braiding device of claim 1, wherein the plurality of module elements are configured to braid three-dimensional fibrous semifinished products by being arranged in several planes relative to each other.

4. The braiding device of claim 1, wherein the plurality of module elements are configured to braid tubular fibrous semifinished products by being arranged in a circle.

5. The braiding device of claim 1, further comprising:

a servicing device that forms at least one parking position for at least one braiding bobbin carrier.

6. The braiding device of claim 1, further comprising:

a controller configured to control the plurality of module elements such that a multidimensional braid is formed with several braiding layers.

7. The braiding device of claim 6, wherein the controller includes a memory unit storing predetermined bobbin paths that form predetermined fibrous semifinished products.

8. The braiding device of claim 1, wherein the braiding bobbin carriers include at least one magnetic area that interacts with the retaining element of the module element.

9. The braiding device of claim 1, wherein the second retaining element comprises a second electromagnet, and the transfer further occurs by initiating a magnetic field of the second electromagnet of the second retaining element.

* * * * *